United States Patent [19]

Hall

[11] Patent Number: 4,565,223

[45] Date of Patent: Jan. 21, 1986

[54] STABILIZED NOSE GUIDE

[75] Inventor: Wayne A. Hall, Taylors, S.C.

[73] Assignee: Steel Heddle Mfg. Co., Greenville, S.C.

[21] Appl. No.: 666,236

[22] Filed: Oct. 29, 1984

[51] Int. Cl.[4] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 3,251,383 | 5/1966 | Kaufmann | 139/91 |
| 3,417,787 | 12/1968 | Kaufmann | 139/91 |
| 4,232,713 | 11/1980 | Kaufmann et al. | 139/91 |
| 4,364,420 | 12/1982 | Kramer | 139/91 |
| 4,366,843 | 1/1983 | Shimizu | 139/91 |

FOREIGN PATENT DOCUMENTS

| | | | |
|---|---|---|---|
| 536407 | 12/1955 | Italy | 139/91 |
| 574573 | 7/1957 | Italy | 139/91 |

*Primary Examiner*—Henry S. Jaudon
*Attorney, Agent, or Firm*—Dority & Manning

[57] ABSTRACT

A nose guide for use on a harness frame having top and bottom slats being joined by end braces to form a substantially rectangular frame. The nose guide has a pair of walls being joined at one end and being separated on the other end so that the separated ends can be slipped over a frame slat and secured to the frame slat by a fastener. The frame slat has a cylindrical bore extending therethrough. Positioned on the inner walls of the separated ends of the nose guide is a pair of cylindrical posts. A cylindrical stabilizing member having an inside diameter slightly greater than the diameter of the posts is placed on the posts and bears against the inner walls of the separated ends of the nose guide and against the surface extending around the bore in the frame slat. Such produces a rigid connection between the nose guide and the frame slat when a screw is inserted through the posts and cylindrical stabilizing member.

2 Claims, 5 Drawing Figures

STABILIZED NOSE GUIDE

BACKGROUND OF THE INVENTION

The invention relates to a weaving loom harness and more particularly to a nose guide attached to the top and bottom frame slats of a heddle frame having a nose portion which protects the frames and keeps adjacent heddle frames from clashing into one another during the weaving operation on a loom. A plurality of harness frames are carried on the loom for shifting the warp yarns to form a shed during the weaving operation. It is desirable that these harness frames which are carried closely adjacent each other not clash as they reciprocate up and down during the shedding operation. In order to prevent the clashing of the harness frames, each of the harness frames has nose guides which project laterally beyond the edge of the harness frame and also above and below the harness frames. The nose guides of adjacent harness frames are carried in alignment so that as the harness frame reciprocates in the up and down motion, they rub against each other aiding in maintaining the proper spacing between the harness frames and also aiding in maintaining the harness frames in a substantially vertical position during the shedding operation.

One problem encountered with nose guides heretofore is that they will tend to bend or be deflected relative to the harness frame during the weaving operation. As they bend, this sometimes allows the frames to clash into one another. It is desired that there be a rigid connection between the nose guide and the harness frame so that the nose guides will apply a force to the harness frame during the shedding operation preventing the harness frame from deflecting into the path of the next adjacent harness frame during the shedding operation.

One particular harness frame presently being utilized is constructed of a plastic material such as nylon or silicon filled nylon and connected to the frame slat by means of a threaded screw which extends through the side wall of a lower separated end portion of the nose guide. The threaded screw also extends through posts carried on the inside walls of the separated end portions of the harness frame which abut against each other. It has been found that this connection sometimes permits the harness frame to be deflected horizontally relative to the harness frame and, as a result, during the shedding operation, the harness frame does not remain in the desired vertical path.

SUMMARY OF THE INVENTION

In order to minimize the possibility of the harness frame deflecting relative to the nose guide, a cylindrical stabilizing member is inserted between the inner walls of the separated ends of the nose guide and encompasses the inwardly projecting posts carried on the opposed inner walls of the separated ends of the nose guide. This cylindrical stabilizing member has an inside diameter which is substantially the same as the diameter of the posts so as to provide a snug fit therebetween when the cylindrical stabilizing member is inserted over the inwardly projecting posts.

The opposed ends of the cylindrical stabilizing member abut against opposed inner walls of the separated end portions of the nose guide.

The outside diameter of the cylindrical stabilizer member is only slightly greater than the diameter of a bore extending through the frame slat. As a result, there is a snug connection between the surface surrounding the bore extending through the frame slat and the outer surface of the cylindrical stabilizing member.

A threaded screw is then inserted through the posts, and the cylindrical stabilizing member for drawing the two separated lower end portions of the nose guide tightly together with the cylindrical stabilizing member encompassing the opposing posts carried on the opposed side walls of the separated ends of the nose guide.

Such produces a much more rigid connection between the nose guide and the frame slat minimizing the deflection of the harness frame from its desired vertical path of travel during the weaving or shedding operation.

Accordingly, it is an important object of the present invention to provide a nose guide with a cylindrical stabilizing member for aiding in attaching the nose guide to the frame slat of a harness frame.

Another important object of the present invention is to provide a simple nose guide that is rigidly connected to a frame slat for aiding in maintaining the harness frame in a substantially vertical position as it moves up and down during the weaving operation.

Still another important object of the present invention is to provide an improved nose guide connection for minimizing deflection of the heddle frame relative to the nose guide during weaving.

BRIEF DESCRIPTION OF THE DRAWINGS

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
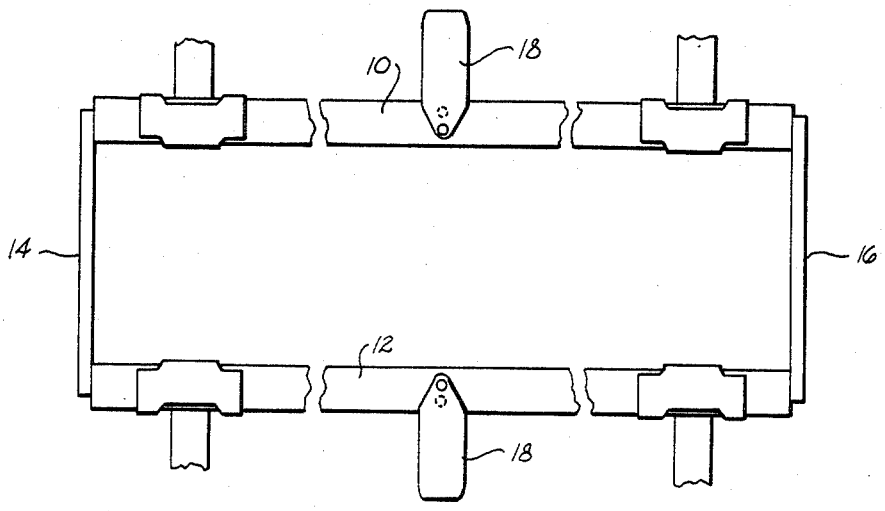
FIG. 1 illustrates a conventional harness frame equipped with a nose guide.
Figure 2:
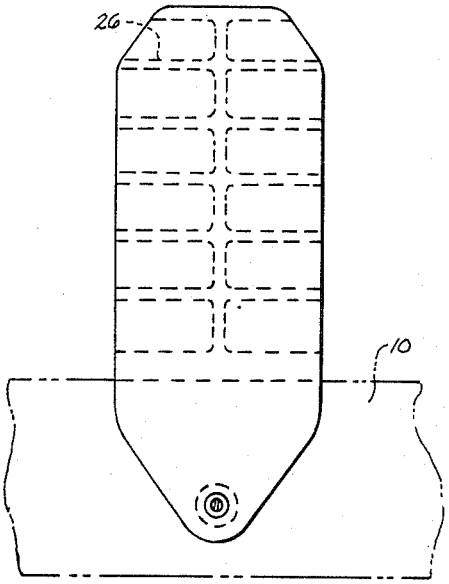
FIG. 2 is an enlarged side elevational view illustrating a nose guide constructed in accordance with the present invention mounted on a frame slat.

In FIG. 1, there is disclosed a conventional harness frame which includes a pair of vertically spaced frame slats 10 and 12 which are joined by end braces 14 and 16 producing a substantially rectangular harness frame. This harness frame would be equipped with a heddle rod holders and heddle rods which are not disclosed for purposes of clarity. Typical harness frames showing more completely the structure and the type of nose guides that are used therewith are disclosed in U.S. Pat. Nos. 4,232,713 and 3,417,787.

Nose guides 18 are secured to the upper and lower frame slats 10 and 12 for aiding in guiding the movement of the harness frame during the shedding operation. During the weaving operation, a plurality of the harness frames are positioned adjacent each other and are guided during the movement by the nose guides 18. The nose guides of the adjacent harness frame are in alignment so that they will rub together as the harness frame moves up and down during the shedding operation rather than harness frames themselves striking or clashing against each other.

In one particular embodiment, the nose guide is a molded structure molded from nylon or silicon filled nylon and has a main body portion 20. The main body portion 20 includes a pair of side walls 22 and 24 which are joined by ribbing 26 to maintain paralleling of the side walls. The lower portion of the nose guide includes a pair of separated ends or legs 28 and 30 which can be pulled apart when it is desired to insert the nose guide over the frame slat.

Figure 3:
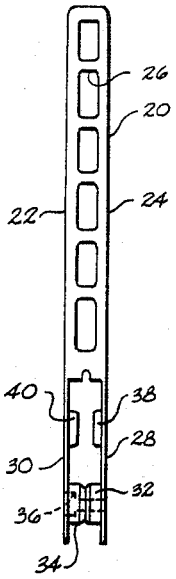
FIG. 3 is a side elevational view of a conventional nose guide.

In FIG. 3, there is shown a conventional nose guide. Carried on the inner walls of the separated legs 28 and 30 and in line with each other are a pair of cylindrical posts 32 and 34. The posts 32 and 34 have a countersunk bore 36 provided thereon for receiving a screw for securing the separated legs 28 and 30 together when the nose guide is mounted on the frame slat. It is noted that the counter-sunk bore 36 has an enlarged diameter portion for receiving the head of the screw which is carried in the post 34 and a reduced diameter portion for receiving the shank portion of the screw which is received in the posts 32. In the conventional nose guide, it also has a pair of positioning posts 38 and 40 carried on the inner walls of the separated legs for aiding in positioning the nose guide on the frame slat.

One problem with the nose guide as shown in FIG. 3 is that during the weaving operation, the nose guide tends to bend relative to the harness frame at the point of attachment which is made through the threaded screw. When the nose guide is permitted to bend at the point of connection with the frame slat, then the adjacent harness frames will tend to clash during the shedding or weaving operation.

In order to minimize the deflecting and bending of the nose guide relative to the harness frames, a cylindrical stabilizing member 44 is utilized.

Figure 4:
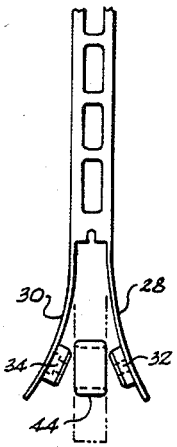
FIG. 4 is a side elevational view of a nose guide constructed in accordance with the present invention with the lower ends pulled apart to show the manner in which a cylindrical stabilizing member is positioned therebetween.
Figure 5:
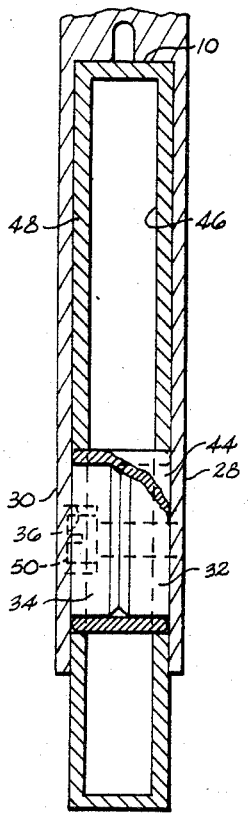
FIG. 5 is an enlarged cross sectional view of a nose guide constructed in accordance with the present invention illustrating the manner in which a cylindrical stabilizing member is used for attaching a nose guide to a frame slat.

As shown in FIG. 4, the cylindrical stabilizing member 44 is inserted in a bore extending through the opposed side walls 46 and 48 provided in the frame slat 10. The cylindrical bore has a first diameter which is slightly greater than the outside diameter of the cylindrical stabilizing member 44. The inside diameter of the cylindrical stabilizing member 44 is slightly greater than the diameter of the posts 32 and 34 and for purposes of reference, the outside diameter of the posts is referred to as a second diameter. As a result, there is a snug fit between the inner surface of the cylindrical stabilizing member and the surface of the posts 32 and 34. There is also a snug fit between the outer surface of the cylindrical stabilizing member and the surface surrounding the bore extending through the walls 48 and 46 of the frame slat.

The opposed ends of the cylindrical stabilizing member 44 abut against the inside walls of the separated end portions 28 and 30. As a result of the cooperating positioning of the cylindrical stabilizing member on the posts 32 and 34 and the surrounding surface provided by the inner wall of the separated end portions 28 and 30 and the surface surrounding the bore, a positive and rigid connection is provided between the nose guide and the frame slat 10.

This aids in maintaining the harness frame in alignment with the nose guide as the harness frame is moved up and down during the weaving operation and, accordingly, minimizes clashing between adjacent harness frames.

The threaded screw 50 is used for fastening the two separated ends 28 and 30 together. The threaded screw 50 has an enlarged head which is countersunk in the separated end 30 with a shank portion being threaded in the separated end 30. When the screw is tightened, it draws the separated side end portions 28 and 30 tightly against the frame slat 10.

It will be understood, of course, that while the form of the invention herein shown and described constitutes a preferred embodiment of the invention, it is not intended to illustrate all possible forms of the invention. It will also be understood that the words used are words of description rather than of limitation and that various changes may be made without departing from the spirit and scope of the invention herein disclosed.

What is claimed is:

1. A nose guide for use on a harness frame having top and bottom slats being joined by end braces to form a substantially rectangular frame, said nose guide having a pair of walls being joined at one end and being separated on the other end so that said separated ends can be slipped over a frame slat and secured to said frame slat by means of a fastener extending through said separated ends and said frame slat, the improvement comprising:

a cylindrical bore of a first diameter provided in said frame slat;

a first cylindrical post of a second diameter carried on an inner wall of one of said separated ends of said nose guide, a second cylindrical post of said second diameter carried on an inner wall of the other separated end of said nose guide directly opposite said first cylindrical post so as to abut against said first cylindrical post when said separated ends of said nose guides are brought together with said first and second cylindrical post extending through said cylindrical bore in said frame slat, a cylindrical stabilizing member having an inside diameter slightly greater than said second diameter to slip on said first and second cylindrical posts;

said cylindrical stabilizing member having an outer diameter slightly less than said first diameter so as to be inserted in said bore of said frame slat;

said cylindrical stabilizing member being carried on and encompassing said first and second post with opposed ends of said cylindrical stabilizing member abutting against said opposed inner walls of said separated ends of said frame slat, and said fastener drawing said separated ends tightly together against said frame slat causing said cylindrical post to abut against each other with said ends of said cylindrical stabilizing member abutting against said inner walls of said separated ends of said nose guide producing a rigid connection between said nose guide and said frame slat.

2. The nose guide as set forth in claim 1 wherein:

the surface surrounding said bore in said slat being in contact with an outer surface of said cylindrical stabilizing member.

* * * * *